US008250685B1

(12) United States Patent
Kocet

(10) Patent No.: US 8,250,685 B1
(45) Date of Patent: Aug. 28, 2012

(54) BODY LIFTING WRAP

(76) Inventor: Lindsay Kocet, Highlands Ranch, CO (US)

( * ) Notice: Subject to any disclaimer, the term of this patent is extended or adjusted under 35 U.S.C. 154(b) by 0 days.

(21) Appl. No.: 13/240,864

(22) Filed: Sep. 22, 2011

(51) Int. Cl.
*A61G 7/14* (2006.01)
*A61G 7/12* (2006.01)

(52) U.S. Cl. ..... 5/81.1 T; 5/89.1; 5/627

(58) Field of Classification Search ..... 5/81.1 T, 5/89.1, 81.1 R, 627, 625
See application file for complete search history.

(56) References Cited

U.S. PATENT DOCUMENTS 1,035,642 A * 8/1912 Rosse ..... 294/140
3,013,282 A * 12/1961 Volvasek ..... 5/627
5,396,670 A * 3/1995 Firebaugh et al. ..... 5/89.1
5,530,975 A * 7/1996 Firebaugh et al. ..... 5/81.1 T
5,647,378 A * 7/1997 Farnum ..... 128/876
6,073,280 A * 6/2000 Farnum ..... 5/89.1
6,289,534 B1 * 9/2001 Hakamiun et al. ..... 5/89.1
7,624,458 B2 * 12/2009 Felling ..... 5/81.1 T

* cited by examiner

*Primary Examiner* — Robert G Santos

(74) *Attorney, Agent, or Firm* — Richard W. Hanes; Hanes & Bartels LLC

(57) ABSTRACT

A body wrap for quick lifting and transport of a patient's body or provide assistance to a patient or accident victim in standing or securing an injured limb during transport in a wheelchair, comprising a flexible canvas wrap that is placed and secured around parts of the body and where the supporting wrap has flexible handles that permit the wrap to be grasped and lifted by one or more attendants.

2 Claims, 7 Drawing Sheets

BODY LIFTING WRAP

FIELD OF THE INVENTION

The present invention relates to a flexible litter device for lifting and transferring an incapacitated person.

BACKGROUND OF THE INVENTION

Removing and transporting an injured accident victim from a wrecked automobile presents problems that cannot be dealt with by stretchers or the gurneys that are standard equipment in ambulances and rescue vehicles. The problem has been addressed in some prior art patents but the solutions offered are complex and largely inefficient. In less critical types of situations there is a need for facilitating movement of a patient from one area to another when no mechanical means are available.

U.S. Pat. No. 7,168,110 discloses a transfer harness for lifting and transporting a large person but it does not provide for easy attachment to the victim or means for attending personnel to lift the harness.

U.S. Pat. No. 4,422,454 provides for an emergency extrication appliance but its cervical immobilizing collar and body straps unduly complicate the apparatus and are unnecessary if neck injuries are not suspected.

Published U.S. patent application No. US2002/0149253 discloses seating apparatus enabling rapid removal of an injured occupant from a vehicle in which the seat is installed. The disadvantage of this device is that is must be installed in the vehicle to be of any use.

The primary object of the present invention is to provide a simple low cost lifting wrap that can be quickly and easily inserted beneath or around the body or body extremities of an injured or incapacitated person and, with the aid of lifting handles attached at appropriate points on the wrap, the person can be transported by two attendants.

SUMMARY OF THE INVENTION

Generically, the present invention comprises a flexible canvas supporting wrap having means to secure it around a portion of a human body and having flexible handles attached at appropriate points to the wrap to permit the wrap and a human body or the extremities thereof to be lifted and transported.

DETAILED DESCRIPTION OF PREFERRED EMBODIMENT

Figure 1:
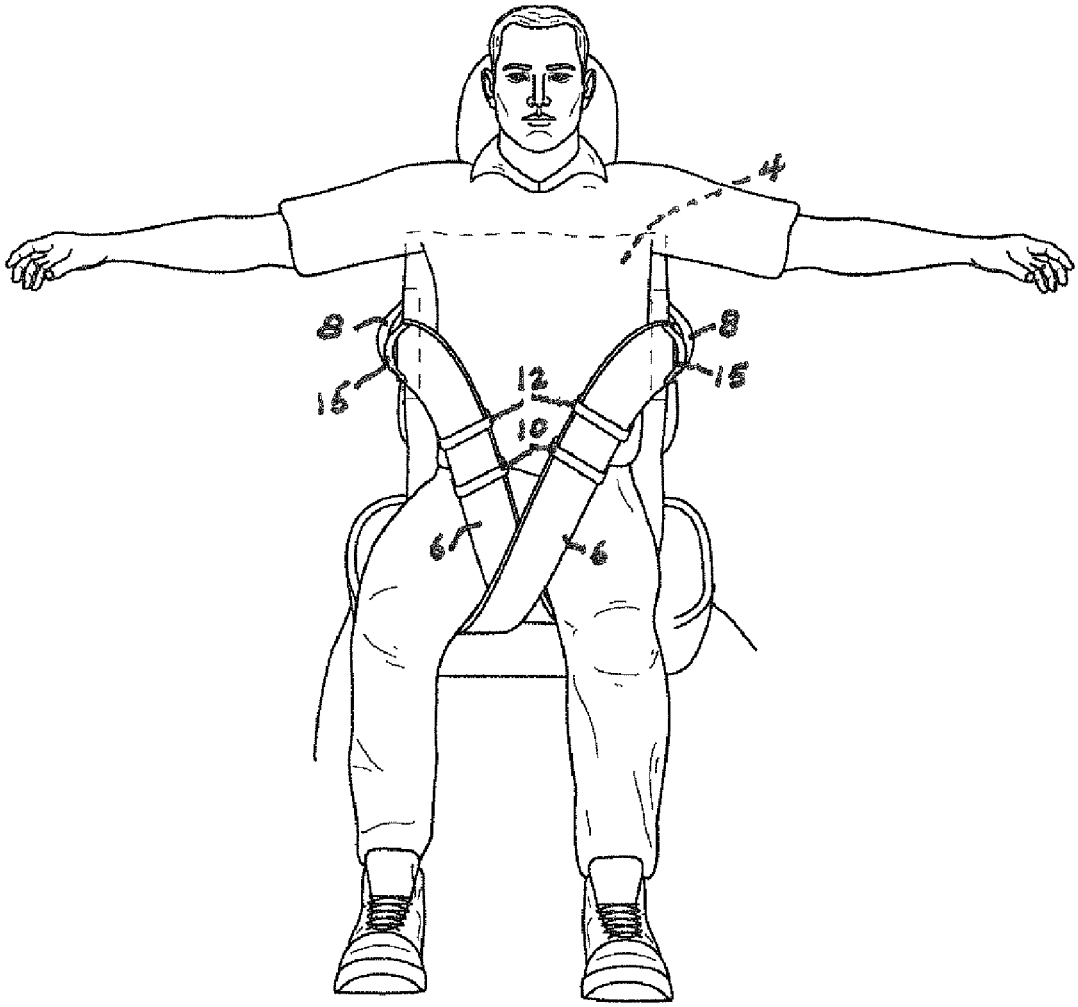
FIG. 1 is a front view of a seated patient with the preferred form of the lifting wrap in place on the back side of the patient.
Figure 2:
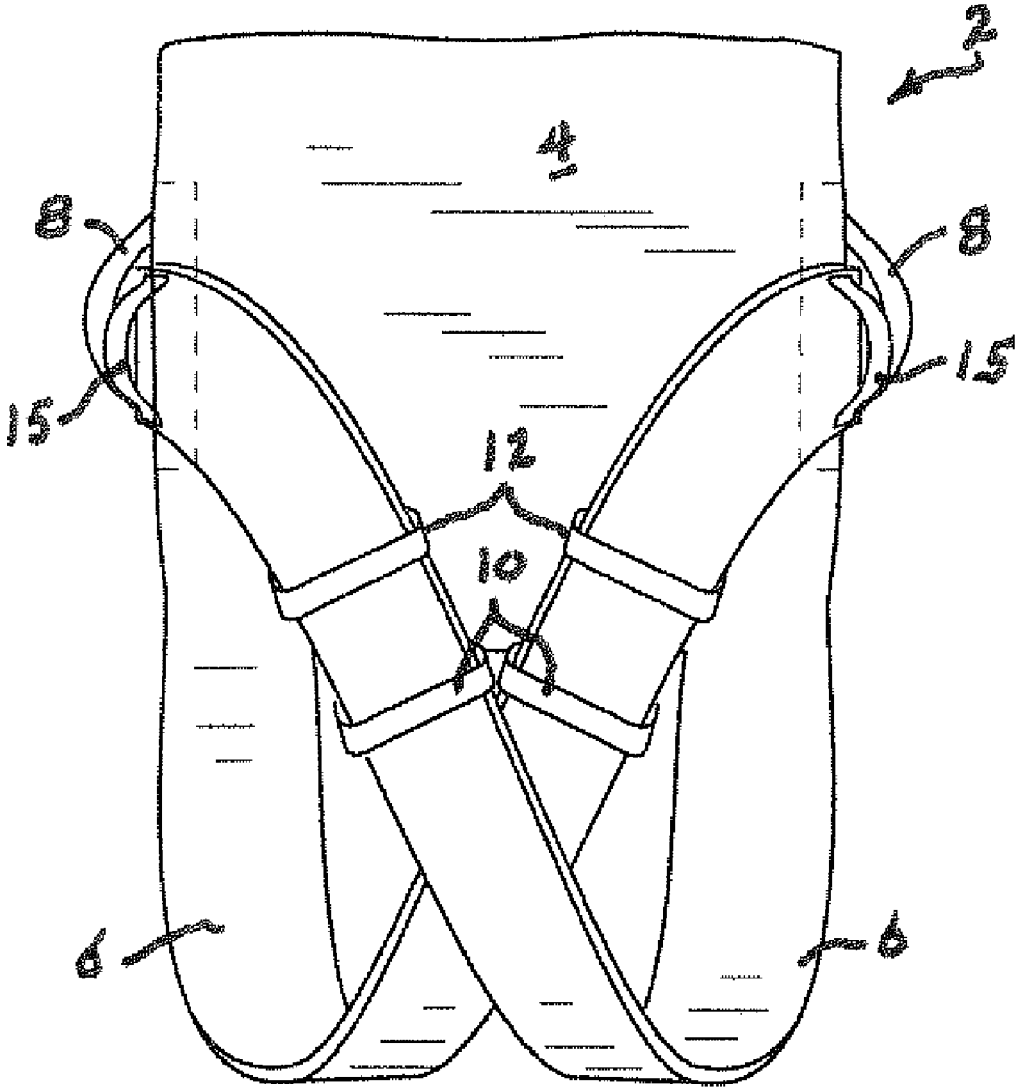
FIG. 2 is a front view of the preferred form of lifting wrap with the leg portions folded in the position shown in FIG. 1.
Figure 3:
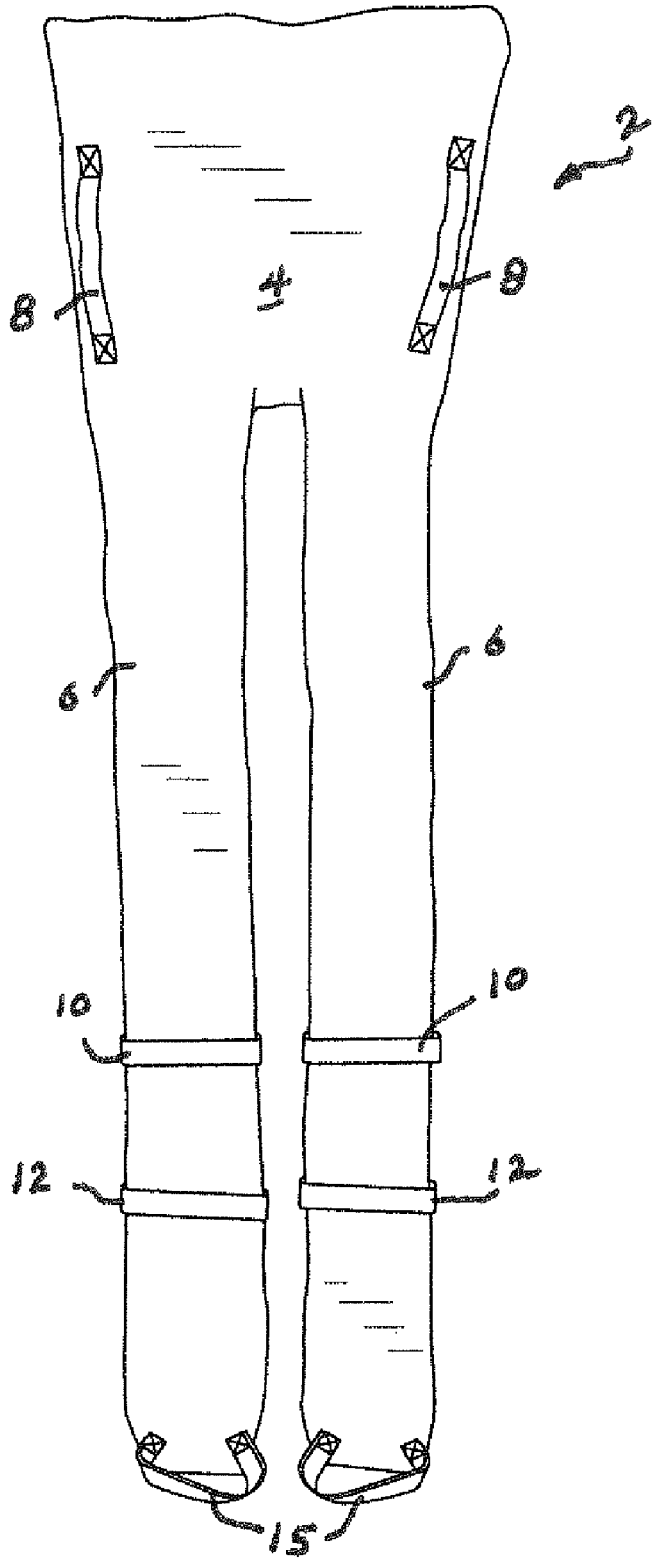
FIG. 3 is a front view of the preferred form of lifting wrap with the leg portions shown in a straight unfolded position.

The preferred form of the body lifting wrap is shown in FIGS. 1-3. The wrap 2 is constructed of a firm or closely woven cloth, such as canvas, and comprises a back support 4 and a pair of depending legs 6. A fabric handle 8 is attached to each lateral side of the back support. Spaced apart leg handles 10 and 12 are attached to the lower portion of each leg 6. At the distal end of each leg is attached a fabric end handle 15.

In operation, the flexible back support 4 is inserted beneath the patient by sliding it behind the patient's back and puling the legs 6 up under the thighs, and around the torso and chest to a position, as shown in FIG. 1, where the end handles 15 are in close proximity to the lateral back support handles 8. This allows the patient to remain seated during application of the wrap. An attendant on one side of the patient grasps the handles 15 and 8 with one hand and grasps one or the other of the leg handles 10 and 12. An attendant on the other side of the patient takes hold of the oppositely positioned handles. Together, the attendants may lift the patient and carry him/her to a stretcher or gurney or other location. Head, neck and spine immobilization are not required because the wrap is used to assist in removing a patient quickly from one area to another when no other means of lifting or transport is available and where the patient is known not to require such immobilization. For example, when a patient is driven by a family member to an emergency department and the family member is unable to help the patient from the vehicle a couple of attendants can easily insert the wrap and remove the patient. In essence the wrap adds handles to a patient who would otherwise have to be gripped under the armpits or around the waist. The same technique is employed using the wrap to remove an injured person from a vehicle.

Figure 4:
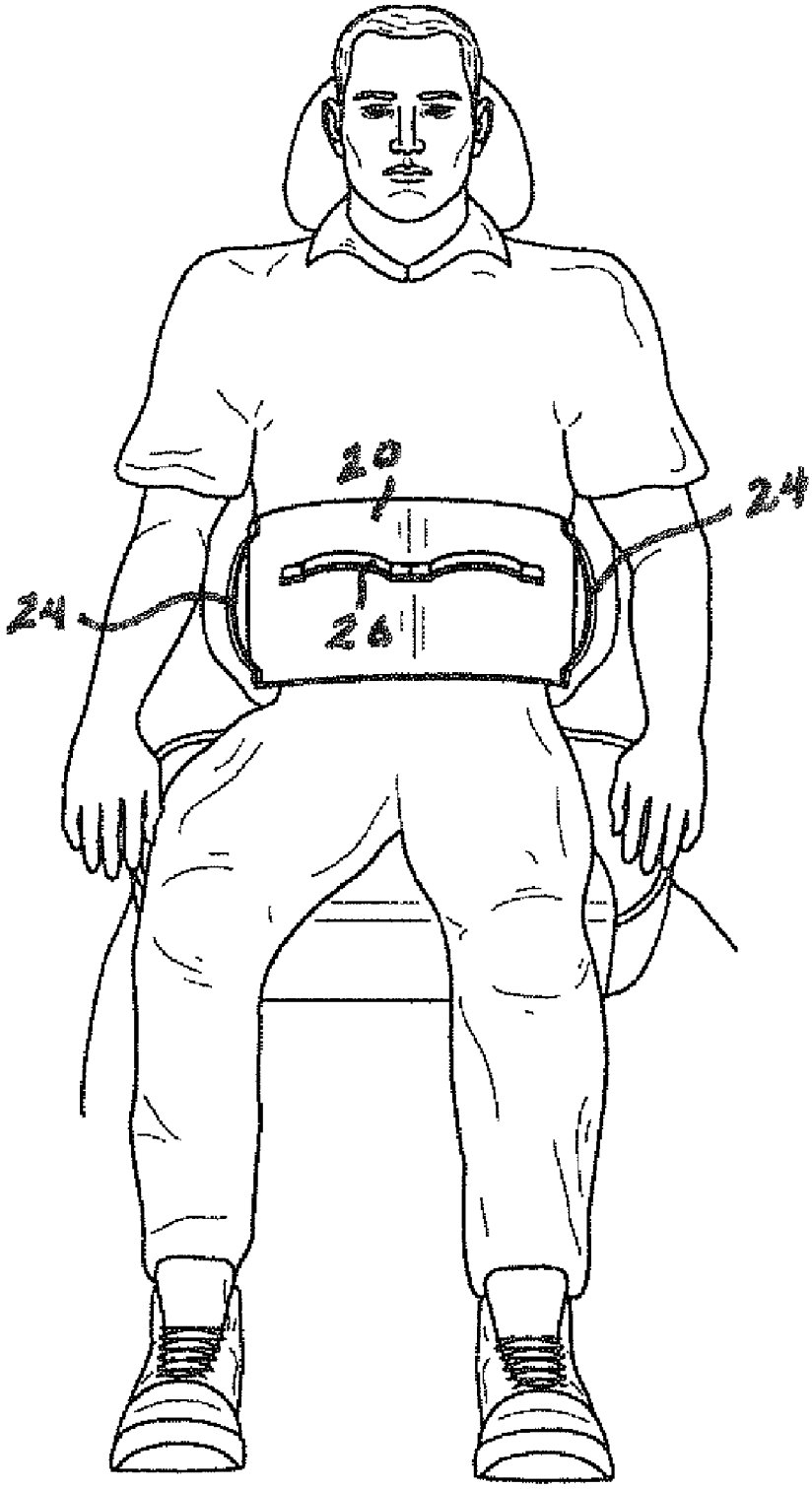
FIG. 4 is a front view of a seated patient with an alternative form of the lifting wrap secured around the abdomen and lower back of the patient.
Figure 5:
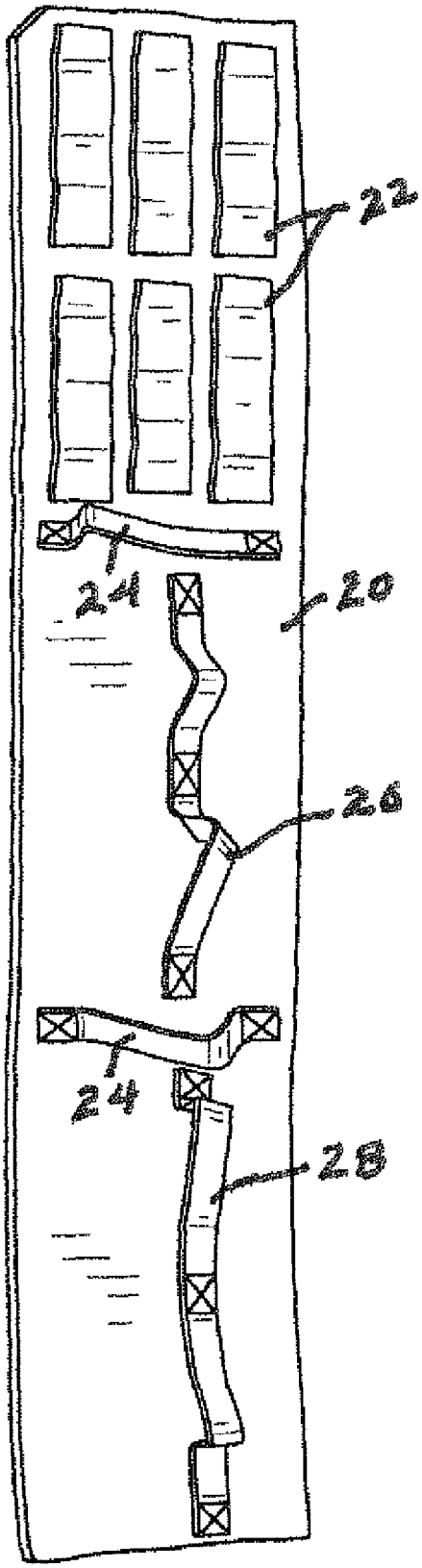
FIG. 5 is a plan view of the unfolded form of the lifting wrap shown in FIG. 4.

A second form of the invention is seen illustrated in FIGS. 4 and 5. In instances where a patient can stand but needs assistance getting from a sitting position to a standing position, and the reverse, the canvas wrap 20 is wrapped around the abdomen and secured in position with loop and hook type of fastener material 22. Lateral lifting handles 24 provide means for grasping the sides of the wrap and front and back handle pairs 26 and 28 are provided for lifting or stabilizing the patient's mid-section when approached from either the front or rear of the patient.

Figure 6:
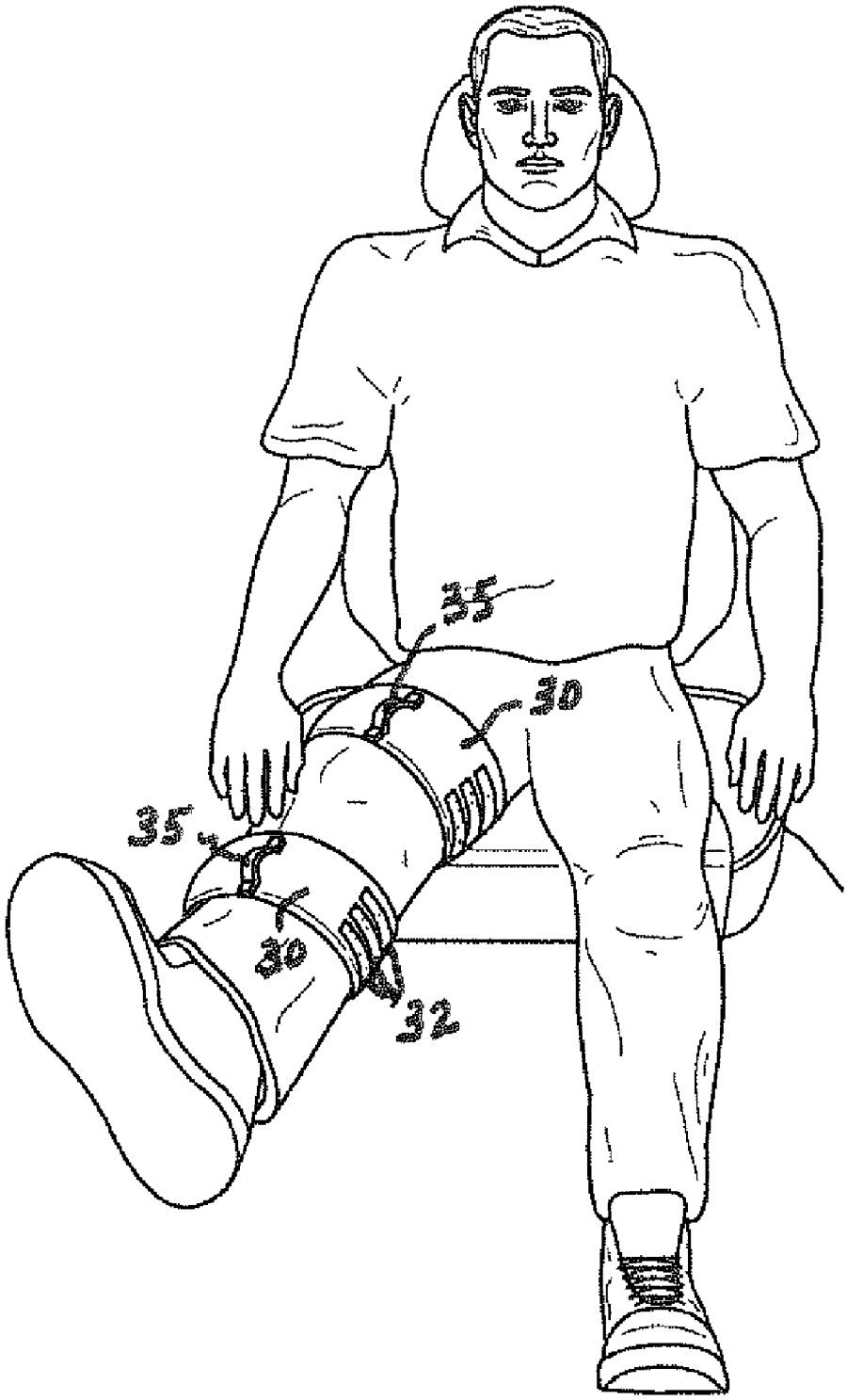
FIG. 6 is a front view of a seated patient with a second alternative form of the lifting wrap secured around one of the lower extremities of the patient.
Figure 7:
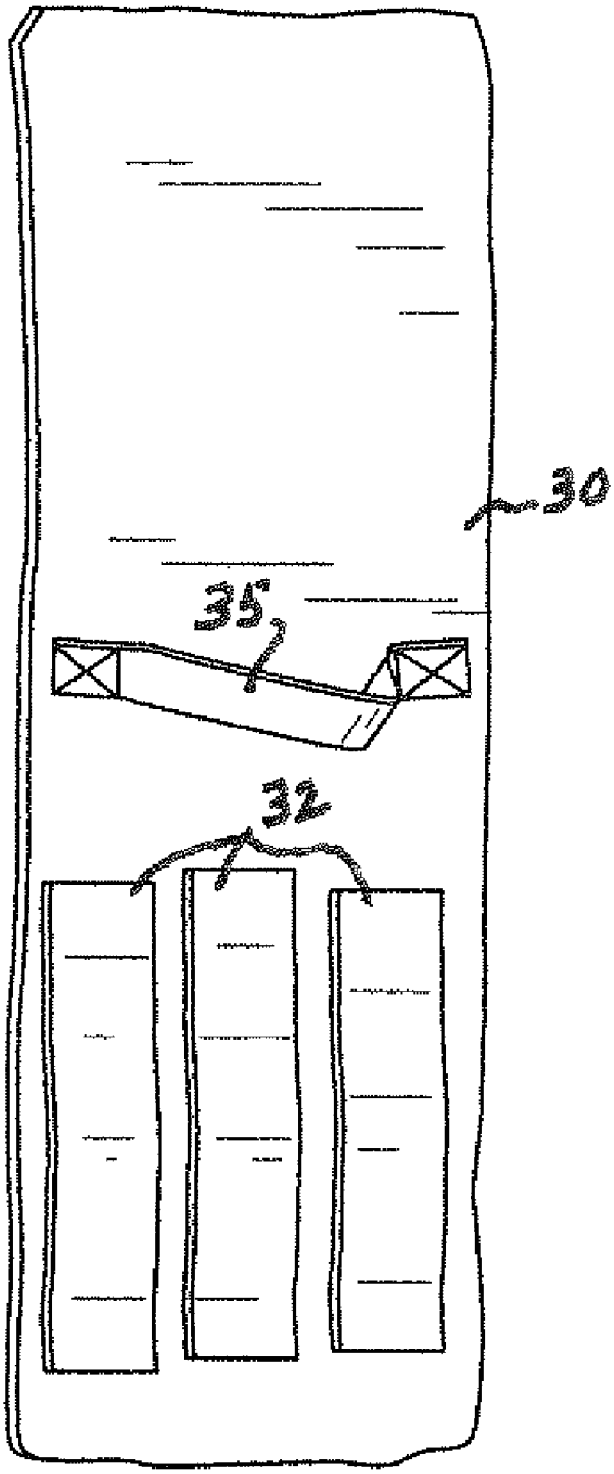
FIG. 7 is a plan view of the unfolded form of the lifting wrap shown in FIG. 6.

The third embodiment of the invention is illustrated in FIGS. 6 and 7. An elongated canvas leg wrap 30 is provided with hook and loop fastening material 32 to secure the wrap 30 in position around a patient's extremity and in particular a patient's leg. A single handle 35 attached to the wrap enables an attendant to raise a patient's leg or arm and hold it in position while the patient is being moved or transported from the scene of an accident or when moving a patient from one place to another in a wheelchair. An attendant or care giver will use the wrap 30 to support the injured extremity without having to bend and stoop at the waist while walking backward and "carrying' the injured extremity.

What is claimed is:

1. A litter for lifting or carrying a disabled person, comprising, a quadrilateral shaped flexible torso support having top and bottom edges and non parallel lateral sides and a torso facing surface, a flexible handle having spaced apart first and second ends, each of said ends being attached to and within the perimeter of the torso facing surface proximate to and parallel with each of the non parallel lateral sides, and where the portion of the handle intermediate the said ends is spaced from the torso facing surface to allow for gripping of the handle, a pair of elongated leg members depending from and integral with the bottom edge of the torso support, each having a torso facing surface and distal ends, a flexible handle attached to the distal end of each leg member, a plurality of spaced apart flexible leg handles attached to each leg member intermediate the distal end of the leg and the bottom edge of the torso support, each of said leg handles being spaced apart from the torso facing surface of the leg member to allow for gripping of the handle.

2. A method for one or more persons to lift or carry a disabled person comprising the steps of:

placing the flexible torso support of claim 1 beneath the torso of the disabled person, bringing a first leg member, depending from the torso support, under the left leg thigh of the person and upwardly across the torso of the person to a position beneath the right arm of the person, bringing a second leg member, depending from the torso support, under the right leg thigh of the person and upwardly across the torso of the person to a position beneath the left arm of the person, positioning one of a plurality of flexible handles attached to the first leg member next to a flexible handle attached to a lateral side of the torso support proximate the upper torso of the person and under the person's right arm, positioning one of a plurality of flexible handles attached to the second leg member next to a flexible handle attached to a lateral side of the torso support proximate the upper torso of the person and under the person's left arm, establishing a first lifting point by gripping together the positioned handles under the right arm of the person, establishing a second lifting point by gripping together the positioned handles under the left arm of the person, and lifting the disabled person by applying upward force on the first and second lifting points.

* * * * *